US006204740B1

(12) United States Patent
Nakahata

(10) Patent No.: US 6,204,740 B1
(45) Date of Patent: Mar. 20, 2001

(54) COAXIAL RELAY

(75) Inventor: Atsushi Nakahata, Matsusaka (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/553,945

(22) Filed: Apr. 21, 2000

(30) Foreign Application Priority Data

Apr. 23, 1999 (JP) ..... 11-117309
Apr. 23, 1999 (JP) ..... 11-117310

(51) Int. Cl.[7] ..... H01H 53/00
(52) U.S. Cl. ..... 335/4; 333/103
(58) Field of Search ..... 333/103–109; 335/4, 5, 104, 105, 78–86, 124, 128

(56) References Cited

U.S. PATENT DOCUMENTS

| | | | | |
|---|---|---|---|---|
| 4,496,919 | | 1/1985 | Fournier et al. . | |
| 4,587,502 | * | 5/1986 | Matsuo et al. | 335/85 |
| 4,697,056 | * | 9/1987 | Hoffman | 335/5 |
| 5,047,740 | * | 9/1991 | Alman | 335/4 |
| 5,281,936 | * | 1/1994 | Clazarek | 335/4 |

* cited by examiner

*Primary Examiner*—Lincoln Donovan
*Assistant Examiner*—Tuyen T. Nguyen
(74) *Attorney, Agent, or Firm*—Arent Fox Kintner Plotkin & Kahn, PLLC

(57) ABSTRACT

A coaxial relay is build up from a contact block and an electromagnet block. The contact block carries a plurality of coaxial connectors each composed of a core conductor and a shield conductor surrounding the core conductor. The core conductors extend into a shield chamber to define thereat respective coaxial contacts. At least one movable blade is disposed within the shield chamber for closing and opening the two adjacent coaxial contacts. The movable blade is provided with a dielectric actuator which projects on the top of the contact block and is engaged with a return spring secured to the contact block for urging the movable blade in a direction of opening the coaxial contacts. The electromagnet block carries at least one electromagnet and an armature which is engageable with the actuator when the electromagnet block is assembled to the contact block. The armature moves about a pivot axis from a first position of opening the coaxial contacts to a second position of closing the same. The electromagnet includes a frame of a non-magnetic material which holds the electromagnet and has its lower end secured to the contact block. The frame has a retainer mechanism for pivotally supporting the armature. Thus, a magnetic gap distance between the electromagnet and the armature can be fixed and does not vary a the time of assembling the electromagnet block to the contact block, so that the relay can have a reliable armature movement in response to the excitation of the electromagnet.

13 Claims, 10 Drawing Sheets

150
151
132
131
132
130
74
71
74
70
72
73
73
78
84
79
73
87
81
79
60
88
84
80
87
83
88
124
83
85
85
122
124
82
121
90
122
120
100
120
113
114
121
14
17
50
50
15
17
14
10
20
11
14

COAXIAL RELAY

BACKGROUND OF THE INVENTION

1. Field of the Invention

The present invention relates to a coaxial relay for switching high frequency signals, and more particular to such relay having a pivotable armature moving between two positions of switching the high frequency signals.

2. Description of the Prior Art

U.S. Pat. No. 4,496,919 discloses a coaxial relay with a pivotable armature for switching high frequency signals. The relay includes an electromagnet block and a contact block with a plurality of coaxial connectors each having a core conductor and a shield conductor. The contact block has a shield chamber into which the core conductors extend to define fixed contacts therein. Also mounted within the shield chamber is a movable blade for closing and opening the fixed contacts. The movable blade carries a dielectric actuator which projects on the contact block to be enageable with a pivotable armature and is driven thereby for opening and closing the fixed contacts. The armature is pivotally supported to a support plate fixed to the contact block for movement about a pivot axis between two positions of closing and opening the fixed contacts. The electromagnet block carries an electromagnet with a coil wound around a core and pole ends. The electromagnet block is assembled to the contact block by means of screws, while positioning the core and the pole ends in an opposed relation to the corresponding portions to the armature. In order to assure an accurate armature movement and the therefore the contacting operation in response to the eneraization of the electromagnet, it is required to give precise positioning of the core and the pole ends relative to the armature. However, since the armature is held on the contact block, while the core and the pole ends are held on the electromagnet block, the precise positioning is only made by adjusting the screws and therefore only at the time of assembling the electromagnet block to the contact block. That is, magnetic gap distances between the elements of the electromagnet and the armature is only determined at the time of screwing the electromagnet block to the contact block, so that the precise positioning of the electromagnet relative to the armature can not be always assured. This is inconvenient for manufacturing a number of the relay with reliability of the armature movement, and consequently reduces manufacturing efficiency and reliability.

SUMMARY OF THE INVENTION

In view of the above insufficiency, the present invention has been achieved to present a coaxial relay which is capable of assuring reliable operational characteristics and is easy to manufacture. The coaxial relay in accordance with the present invention is composed of two assemblies or blocks, namely, a contact block and an electromagnet block. The contact block is made of an electrically conductive metal to have a top surface and a shield chamber. The contact block carries a plurality of coaxial connectors each composed of a core conductor and a shield conductor surrounding the core conductor. The core conductors extend into the shield chamber to define thereat respective coaxial contacts. Also included in the contact block is at least one movable blade which is disposed within the shield chamber for closing and opening the two adjacent coaxial contacts. The movable blade is provided with a dielectric actuator which projects on the top surface of the contact block and is engaged with a return spring secured to the contact block for urging the movable blade in a direction of opening the coaxial contacts.

The electromagnet block is separately formed from the contact block to be assembled thereto. The electromagnet block carries at least one electromagnet and an armature which is enageable with the actuator when the electromagnet block is assembled to the contact block. The electromagnet is composed of a coil wound around a core. The armature is responsive to an excitation of the coil to move about a pivot axis from a first position of opening the coaxial contacts to a second position of closing the same. The electromagnet includes a frame of a non-magnetic material which holds the electromagnet and has its one end secured to the contact block. The characterizing feature of the present invention resides in that the frame has a retainer mechanism for pivotally supporting the armature. With the provision of the retainer mechanism on the side of the electromagnet block, a magnetic gap distance between the electromagnet, i.e., the core and the armature can be fixed and does not vary at the time of assembling the electromagnet block to the contact block.

Accordingly, the relay can have a reliable armature movement in response to the excitation of the electromagnet.

Preferably, the frame is configured to have a top wall and a pair of opposed side walls extending from opposite sides of the tope wall. Each of the side walls is formed at its lower end with a pivot projection and with a stem. The armature is an elongated plate provided at its longitudinal center with a pair of transversely spaced brackets having respective bearing holes for loosely receiving therein the stems. The pivot projections, the stems, the brackets with the bearing holes are cooperative with a permanent magnet to define the retainer mechanism for pivotally supporting the armature. The permanent magnet is disposed between the side walls adjacent the lower ends thereof for attracting and holding the armature into a position where the stems loosely fit into the bearing holes and the pivot projections abut respectively against the brackets to define the pivot axis of the armature. Thus, the armature can be easily supported to the frame in an exact positional relation to the electromagnet for reliable armature movement without using a pivot pin and the associated fixture for the pivot pin.

In a preferred embodiment, the contact block includes three coaxial connectors and first and second movable blades. The three coaxial connectors are arranged to define, within the shield chamber, a common fixed contact by the core conductor of one of the coaxial connectors and first and second fixed contacts by the conductors of the other coaxial connectors, respectively. The first movable blade is disposed within the shield chamber to close and open the first fixed contact to and from the common fixed contact, while the second movable blade is disposed within the shield chamber to close and open the second fixed contact to and from the common fixed contact. The armature is movable about the pivot axis between the first position where the first and second movable blades close and open the first and second fixed contacts respectively from and to the common fixed contact, and the second position where the first and second movable blades open and close the first and second fixed contacts respectively from and to common fixed contact.

Preferably, the armature carries on its lower surface a spring plate having a length extending in parallel with the length of the armature. The spring plate includes an anchor section formed at the longitudinal center of the spring plate and a pair of first and second spring legs extending from the anchor section in opposite directions. The anchor sections are secured to the longitudinal center of the armature and are formed integral with the brackets extending transversely beyond width ends of the armature for pivotal connection with the lower ends of the frame. The first and second spring legs extend from the anchor section in a spaced relation with the armature to be engageable respectively with the actuators of the first and second movable blades for providing a contact pressure. Thus, the contact spring alone can combine the functions of supporting the armature to the frame and of giving the contact pressure to the first and second movable blades.

The top surface of the contact block is rectangular in shape and is formed at its four corners respectively with recesses. The frame is configured to have the top wall and a pair of end walls extending from opposite ends of the top wall. The top wall is secured to the core, while the side walls is formed at its one end with legs which fit into the recesses of the contact block and are bonded thereto. Thus, the electromagnet block can be readily assembled to the contact block, while the core is held by the frame in an exact position relative to the armature supported at the lower end of the frame.

Preferably, the contact block is composed of a base carrying the coaxial connectors and a cover plate secured to the base. The cover plate defines the top surface of the contact block and is cooperative with the base to define therebetween the shield chamber. The cover plate is formed with a hole through which the actuator of the movable blade extends for engagement with the armature.

In another embodiment of the present invention, the electromagnet block includes a generally U-shaped members having a horizontal core and a pair of pole legs extending from the opposite ends of the horizontal core. The electromagnet block further includes at least one coil wound around the horizontal core at portions adjacent the pole legs, and a permanent magnet disposed between pole legs. The permanent magnet is magnetized to have opposite poles at its upper and lower ends and is arranged to have its upper end connected to the center of the horizontal core and to have its lower end opposed to the center of the armature. The pole legs define at the lower ends thereof pole ends which are opposed respectively to the longitudinal ends of said armature. This configuration in which the coils are wound around the horizontal cores is advantageous to reduce a height of the electromagnet and therefore the relay.

The actuator is preferably made of a dielectric plastic material and is molded integrally at its lower end with the movable blade. With this insertion molding, the actuator is accurately positioned relative the movable blade so that, when the actuator is stably held by the contact block, the movable blade can be exactly positioned within the shield chamber to give a uniform high frequency characteristic to the contact block, i.e., a consistent impedance to a signal path of the contact block for reliable switching operation of the high frequency signals.

Also, the present invention presents the return spring of unique configuration which is advantageous for stably holding the actuator to guide the actuator along its axis during the movement of the movable blade between the contact closing and opening positions. The return spring comprises a ring with a center spring strip bridging from opposite ends of the ring. The ring has seats which are spaced from connections between the ring and the center spring strip and are secured to the contact block. The connections are raised relative to the seats at which the ring is secured to the contact block. The center spring strip has a longitudinal center which is coupled to the actuator and is raised relative to the connections. With this arrangement, the return spring gives a biasing force to urge the actuator substantially along its vertical axis for guiding the same along the vertical axis against and by the biasing force. Thus, the actuator and the movable blade secured thereto can move exactly along the vertical axis for reliable relay operation. The ring may be rectangular, circular or of lozenge. These and still other advantageous features of the present invention will become more apparent from the following description of the embodiment when taken in conjunction with the attached drawings.

DETAILED DESCRIPTION OF THE EMBODIMENT

Figure 1:
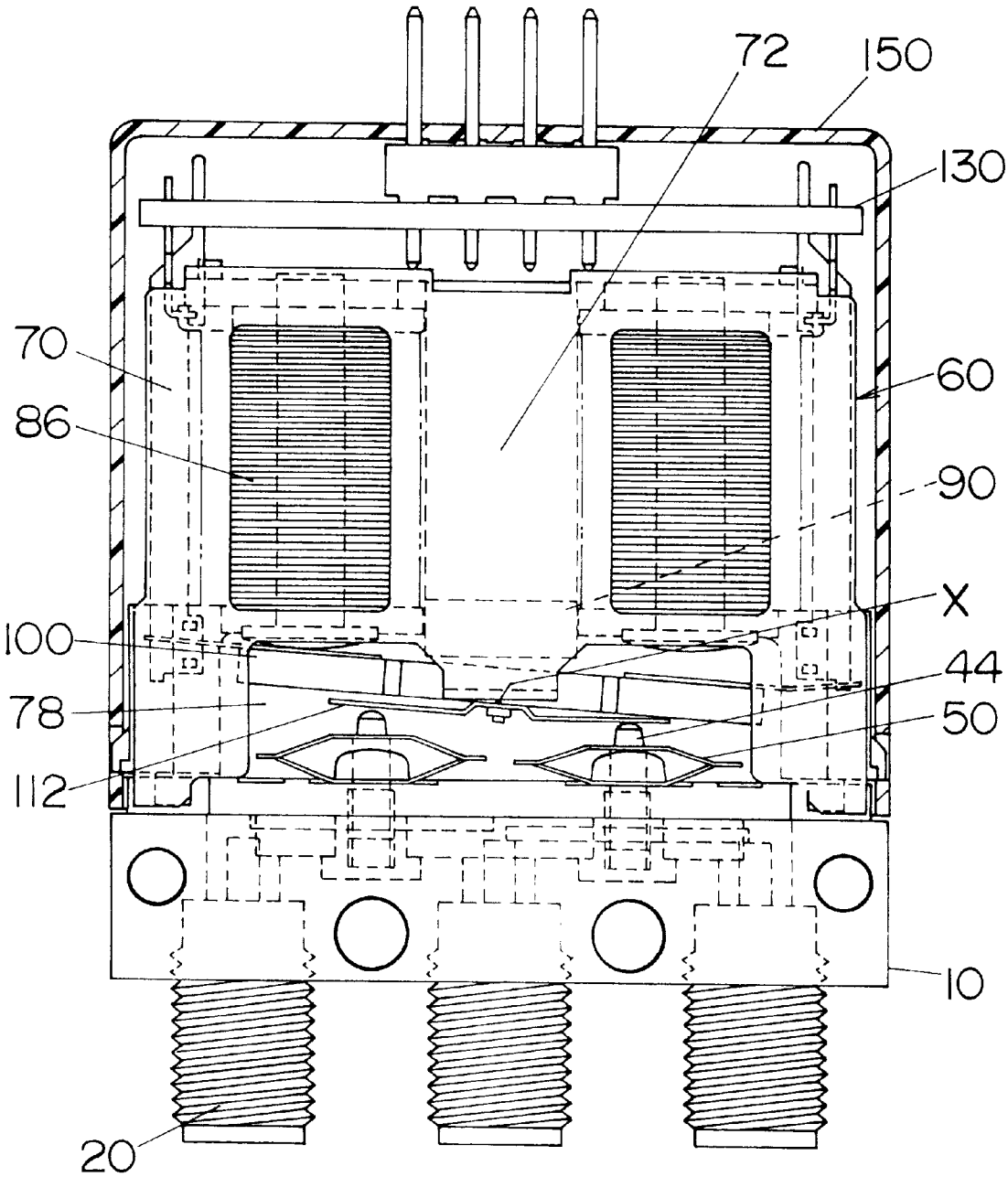
FIG. 1 is a front view in vertical section of a coaxial relay in accordance with a preferred embodiment of the present invention.
Figure 2:
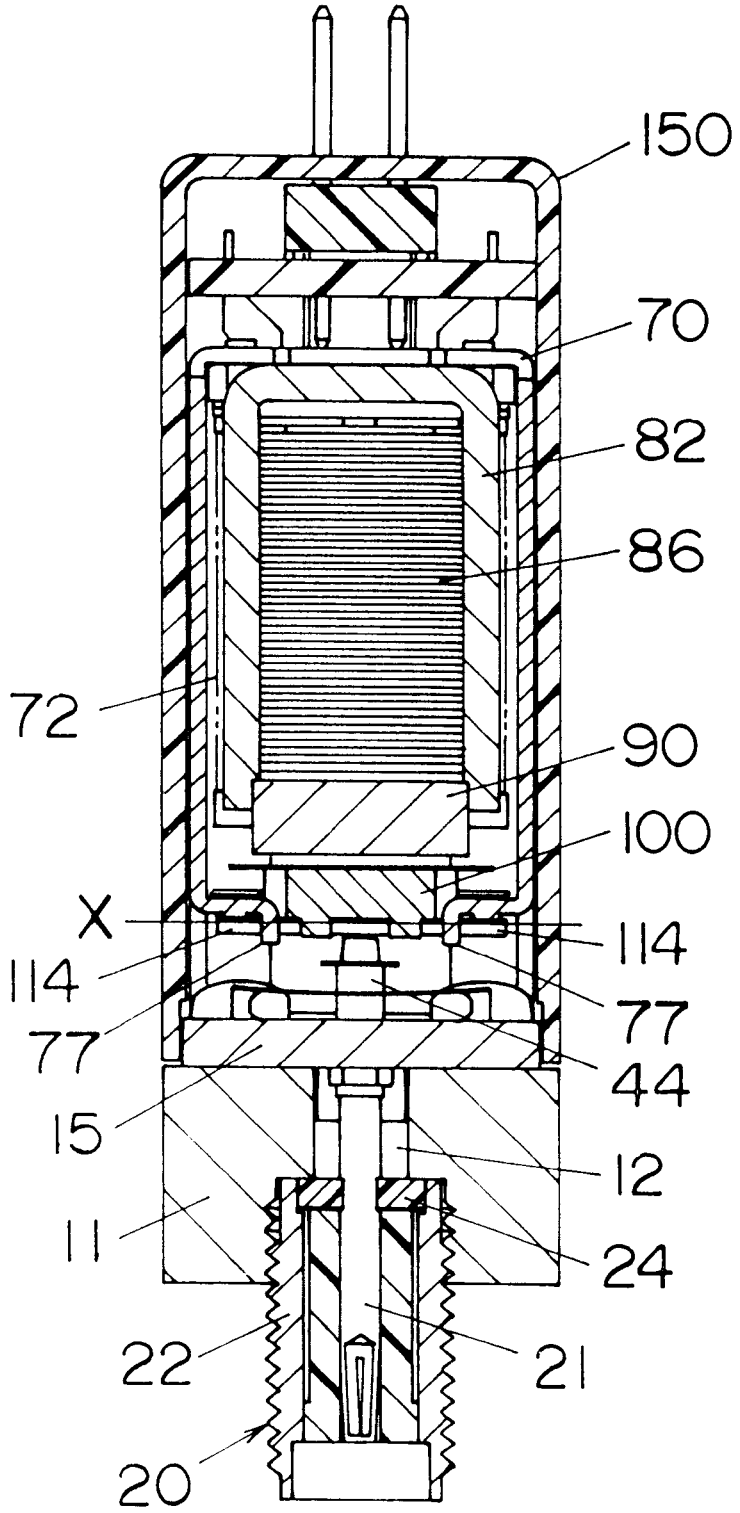
FIG. 2 is a side view in vertical section of the coaxial relay.
Figure 3:
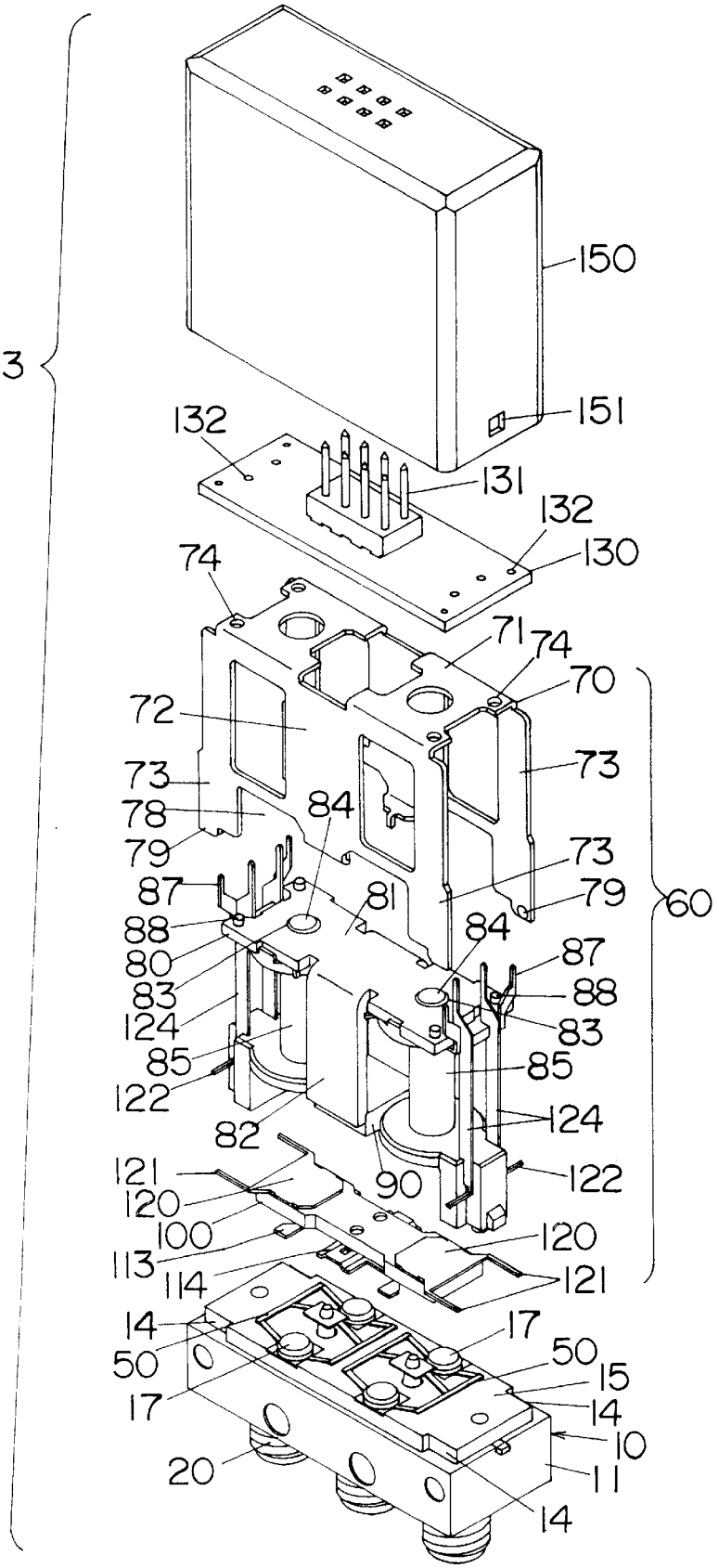
FIG. 3 is an exploded perspective view of the coaxial relay.
Figure 4:
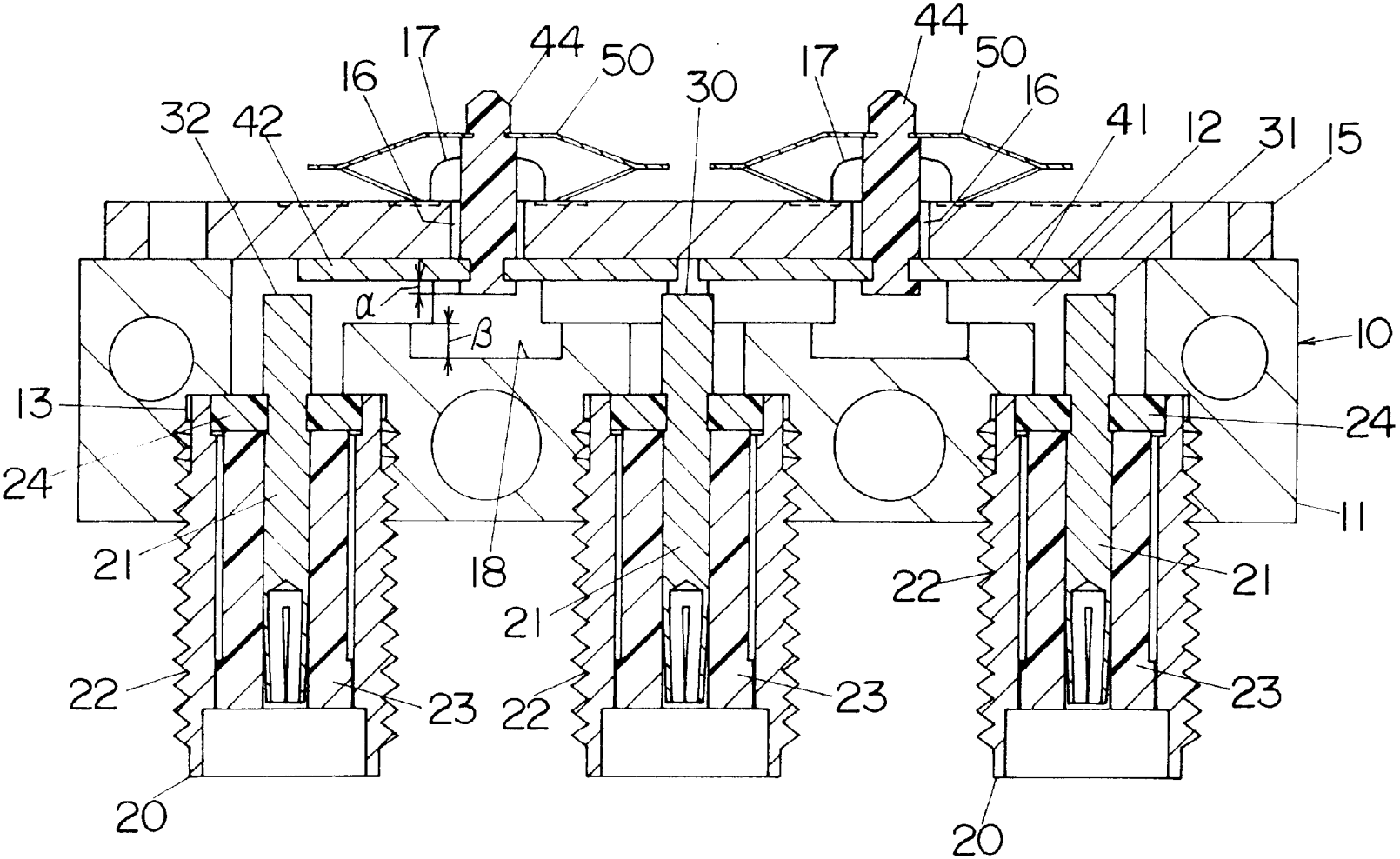
FIG. 4 is a front view in vertical section of a contact block utilized in the above relay.

Referring now to FIGS. 1 to 3, there is shown a coaxial relay in accordance with a preferred embodiment of the present invention. The coaxial relay is designed to switch a high frequency signal at a frequency of 5 to 30 GHz. The relay is composed of a contact block 10 and an electromagnet block 60 which are separately formed from each other. The contact block 10 includes a rectangular base 11 and a rectangular cover plate 15 which are both made of an electrically conductive material and are secured to form therebetween a shield chamber 12. The base 11 mounts three spaced coaxial connectors 20 for connection with coaxial cables carrying a high frequency signal to and from a high frequency circuit. As shown in FIG. 4, each coaxial connector 20 is composed of a core conductor 21, a shield conductor 22, and a dielectric sleeve 23 interposed between the core conductor and the shield conductor. The shield conductor 22 is threaded into a vertical hole 13 of the base 11 to project the core conductor 21 into the shield chamber 12, thereby defining a coaxial contact at the upper end of the core conductor 21. The three coaxial connectors 20 are spaced horizontally to define a common fixed contact 30 by the core conductor 21 of the center coaxial connector 20 and define first and second fixed contacts 31 and 32 by the core conductors of the other two coaxial connectors 20. The cover plate 15 fixed to the base 11 mounts first and second movable blades 41 and 42 which are disposed within the shield chamber 12 so that the first movable blade 41 extends over the first fixed contact 31 and the common fixed contact 30, while the second movable blade 42 extends over the second fixed contact 32 and the common fixed contact 30. Each of the first and second movable blades 41 and 42 has at its center an actuator 44 which projects vertically through an aperture 16 of the cover plate 15 to have its upper end located above the cover plate 15. A return spring 50 is connected between the upper end of each actuator 44 and the cover plate 15 to urge the movable blade upwardly into a contact open position, while allowing the movable blade to move downwardly into a contact close position where the first movable blade 41 establishes the connection between the common fixed contact 30 and the first fixed contact 31, and the second movable blade 42 establishes the connection between the common fixed contact 30 and the second fixed contact 32. The return spring 50 is fixed to the cover plate 15 by means of screws 17 which extend into the base 11 for securing the cover plate 15 also to the base 42. Details of the return spring 50 will be discussed in later.

Turning back to FIG. 3, the electromagnet block 60 includes a frame 70 made of non-magnetic metal, a chassis 80 of a magnetic metal, and an armature 100 of a magnetic material. The frame 70 is shaped from a single plate to have a rectangular top wall 71, a pair of side walls 72 depending from opposite lateral ends at the longitudinal center of the top wall 71, and end walls 73 depending from opposite longitudinal ends of the top wall 71. The chassis 80 has a rectangular top plate 81 and a pair of yokes 82 depending from the opposite lateral ends at the longitudinal center of the top plate 81. The top plate 81 is formed at the longitudinal ends thereof with a pair of holes 83 for securely holding the upper ends of individual cores 84 so that the cores 84 extend vertically in parallel with the yoke 82. Disposed around the individual cores 84 are bobbins 85 which carry individual coils 86. Thus, two electromagnets are formed respectively around the individual cores 84. Each of the coil bobbins 85 mounts a pair of coil terminals 87 connected to the ends of the coil and projecting upwardly for connection with a control circuit. Held between the lower ends of the yokes 82 is a permanent magnet 90 which is magnetized to have opposite poles on the upper and lower surfaces of the permanent magnet 90. The permanent magnet 90 is secured to the lower ends of the yokes 82 by an adhesive with its longitudinal ends mated into notches at the lower ends of the yokes, as best shown in FIG. 2. The top plate 81 of the chassis 80 is formed at its opposite longitudinal ends with studs 88 which fit into corresponding holes 74 in the frame 70 and are riveted thereto for securing the chassis 80 to the frame 70. Thus, the frame 70 fixedly supports the chassis 80 and therefore the electromagnets.

Figure 6:
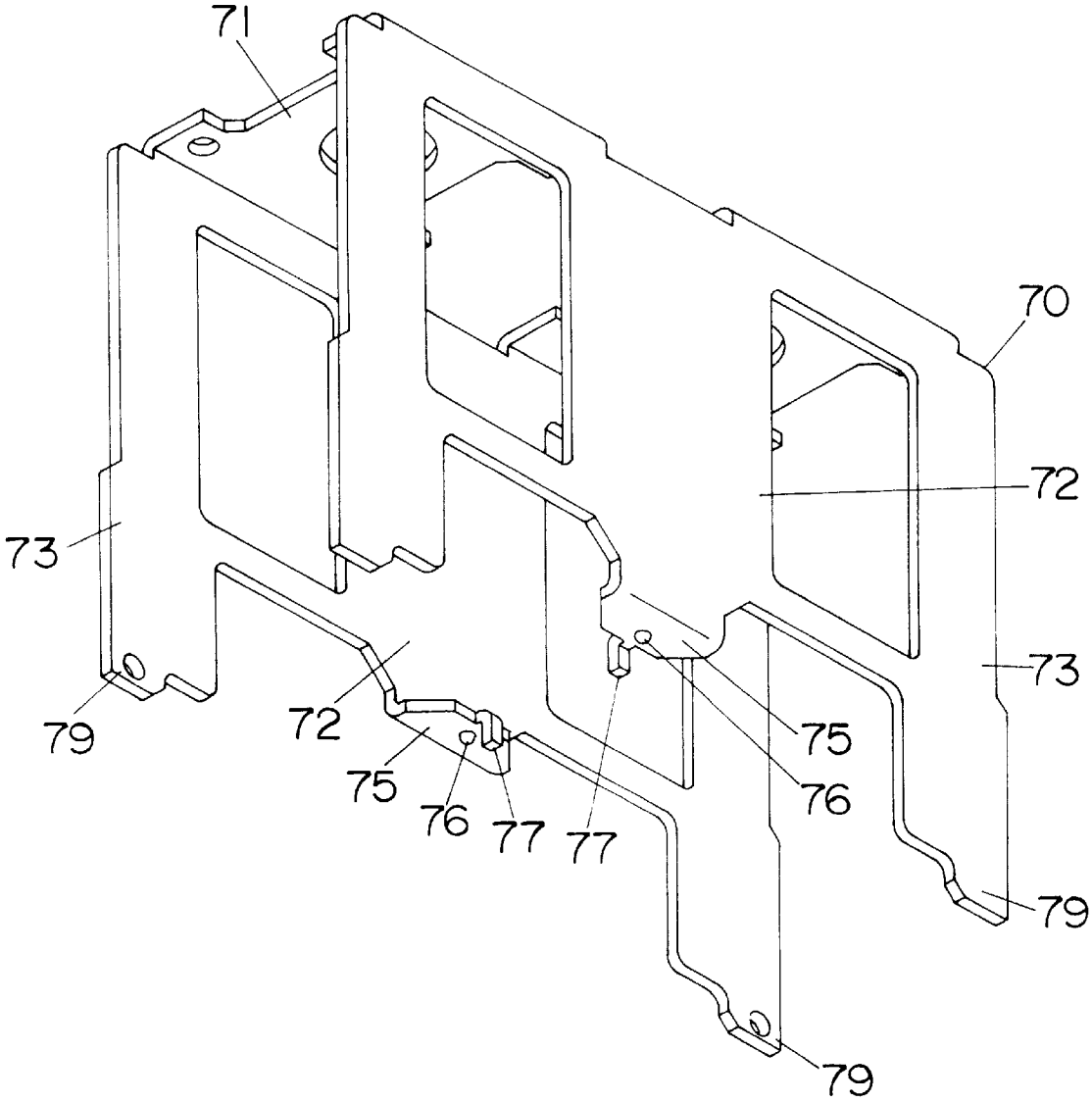
FIG. 6 is a perspective view of a frame utilized in the above relay.
Figure 7:
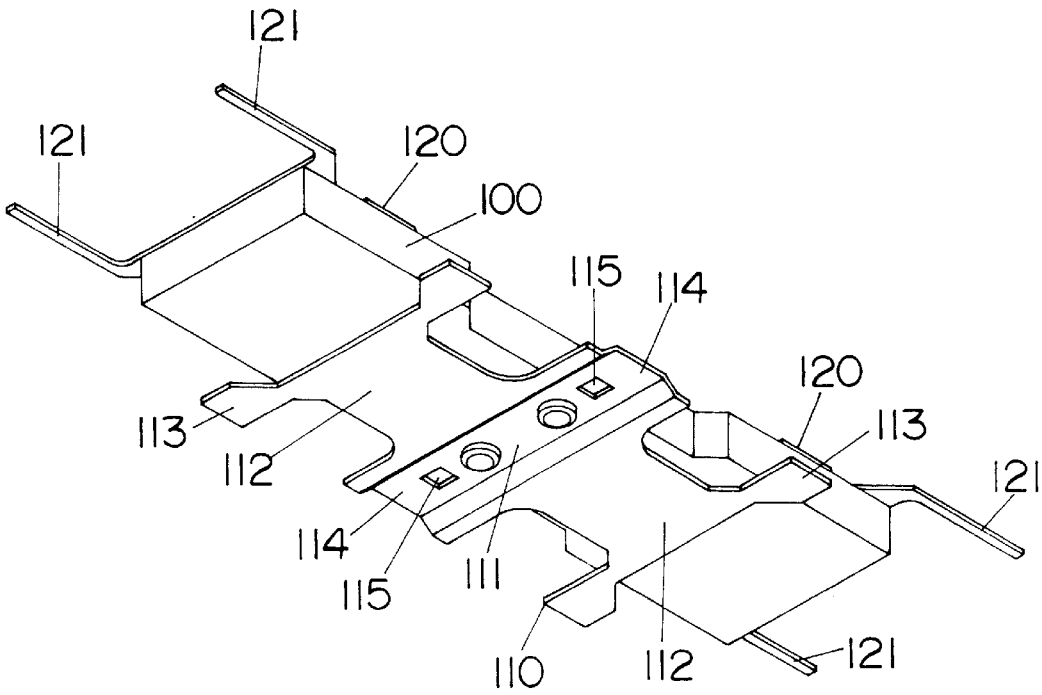
FIG. 7 is a perspective view of an armature utilized in the above relay.

As best shown in FIG. 6, the lower ends of the side walls 72 of the frame 70 are bent inwardly at a right angle to form thereat individual flanges 75 which are formed on the bottom thereof respectively with pivot projections 76. Depending from the inner ends of the flanges 75 are stem 77 for loose connection to the armature 100. As shown in FIGS. 3 and 7, the armature 100 is an elongated plate made of a magnetic material and mounts on its bottom a spring plate 110. The spring plate 110 is also elongated to have a raised anchor section 111 at the longitudinal center of the spring plate 110 and to have a pair of opposed spring legs 112 extending from the anchor section 111. The anchor section 111 has a pair of brackets 114 which extend transversely beyond the lateral ends of the armature for connection with the lower ends of the frame 70. It is the bracket 114 that has a bearing hole 115 into which the stem 77 at the lower end of the frame 70 engage loosely.

Mounting of the armature 100 to the frame 70 is made simply by inserting the stems 77 into the bearing holes 115 in the brackets 114, after which the permanent magnet 90 attracts to hold the armature 100 in position where the pivot projections 76 on the lower end of the frame 70 abut against the brackets 114. Whereby, the armature 100 is pivotally supported to the frame 70 to be movable about a pivot axis defined by the transversely aligned pivot projections 76. It is noted here that since the frame 70 is a one-piece member shaped from the metal sheet to have dimensional stability and the chassis 80 mounting the electromagnets and the permanent magnet 90 is fixedly supported to the frame 70, the armature 100 supported to the lower end of the frame 70 can be accurately positioned relative to the cores 84 and the permanent magnet 90, thereby giving a precise and reliable armature movement in response to the energization of the electromagnets.

The armature 100 thus supported to the frame 70 is allowed to pivot about the pivot axis between first and second positions in response to the energization of the electromagnets. In the first position, as shown in FIG. 1, the armature 100 pushes the first movable blade 41 to connect the first fixed contact 31 to the common fixed contact 30 while the armature 100 is disengaged from the second movable blade 42, allowing it to move upwardly for disconnection of the second fixed contact 32 from the common fixed contact 30. In the second position, on the other hand, the armature 100 pushes the second movable blade 42 to connect the second fixed contact 32 to the common fixed contact 30, while the armature 100 is disengaged from the first movable blade 41, allowing it to move upwardly for disconnection of the first fixed contact 31 from the common fixed contact 30.

The spring legs 112 are held engageable respectively with the actuators 44 of the first and second movable blades 41 and 42 to give suitable contact pressure at which the movable blades are pressed against the coaxial contacts 30, 31, and 32. Formed at the free ends of the spring legs 112 are adjustor tabs 113 which project laterally beyond the lateral ends of the armature 100 to be exposed into openings 78 in the lower ends of the frame 70. Thus, adjusting of the contact pressure after mounting the armature 100 can be made by holding the adjustor tab 113 with a suitable jig and deforming the spring legs 112.

The armature 100 also carries a pair of residual plates 120 on opposite top ends thereof each of which has a pair of integral arms 121 for opening and closing a pair of indicator contacts 122 mounted on the coil bobbins 87. The indicator contacts 122 are provided for giving a signal indicative of the armature operation of closing and opening the coaxial contacts 30, 31, and 32 by the first and second movable blades 41 and 42. For this purpose, the indicator contacts 122 are connected to indicator terminal leads 124 extending upwardly above the frame 70 for connection with an external circuit monitoring the operation of the relay.

In the electromagnet block 60 thus mounting the electromagnets and the armature 100 to the frame 70, the permanent magnet 90 gives a first magnetic flux loop emanating from the magnet 90 through the yokes 82, the one core 84 and the one portion of the armature 100 back to the magnet, as well as to give a second magnetic flux loop emanating from the magnet 90 through the yokes 82, the other core 84, and the other portion of the armature 100 back to the magnet 90 for latching the armature 100 in both of the first and second positions after deenergization of the electromagnets.

Formed at the respective lower ends of the end walls 73 of the frame 70 are positioning legs 79 which fit respectively into recesses 14 formed at the four corners of the cover plate 15 and are welded thereto, thereby assembling the electromagnet block 60 to the contact block 10.

Disposed above the frame 70 is a printed board 130 which mounts a plug 131 for connection of the coil terminals 87 as well as the indicator terminal leads 124 to the external circuits. For this purpose, the printed board 130 has through-holes 132 for connection with the terminals 87 and the terminal leads 124, and internal conductors for connection of the plug 131 and the through-holes 132.

Figure 8:
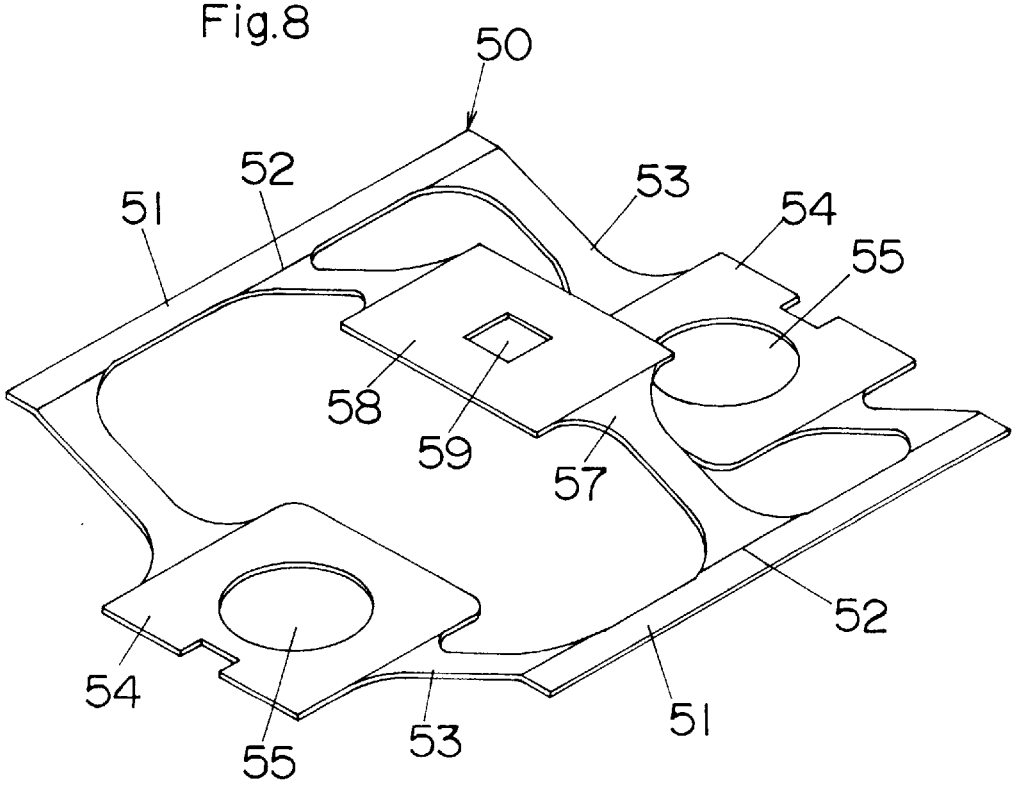
FIG. 8 is a perspective view of a return spring utilized in the above relay.

As shown in FIG. 8, the return spring 50 is a one-piece structure having a rectangular ring with opposed end segments 51, opposed side segments 53, and a center spring strip 57 extending between the opposed side segments 51. Each of the opposed side segments 53 is formed at its center with a seat 54 with a mount hole 55 for receiving a screw 17. The screw 17 extends further through the cover plate 15 into a threaded hole 19 in the base 11 for securing the cover plate to the base and at the same time to fasten the return spring 50 to the cover plate, i.e., the contact block 10. Each of the opposed end segments 51 is raised relative to the seats 54 in the absence of an external force and has connections 52 at the center of thereof with the center spring strip 57. The center spring strip 57 is formed at its center with a piece 58 having a square hole 59 for engagement with the upper end of the actuator 44. In a neutral position where no external force is applied to the piece 58, the piece 58 is kept raised relative to the opposed end segments 51 which are also kept raised relative to the seats 54. When the piece 58 is depressed as a consequence of the actuator 44 being depressed by the armature 100, the center spring strip 57 are resiliently deformed and at the same time the opposed end legs 51 are also resiliently deformed 51, thereby give a spring bias for urging the actuator 44 and therefore the associated movable blade 41, 42 upwardly in a direction of the contact open position. Since the center spring strip 57 and the opposed end legs 51 are resiliently deformed in mutually perpendicular vertical planes respectively including the lengths of the center spring strip 57 and the opposed end legs 51, the actuator 44 can move substantially only along a vertical axis without being tilted, so that the actuator 44 gives no interference with the aperture 16 through which the actuator extends, while the actuator moves vertically.

Figure 5:
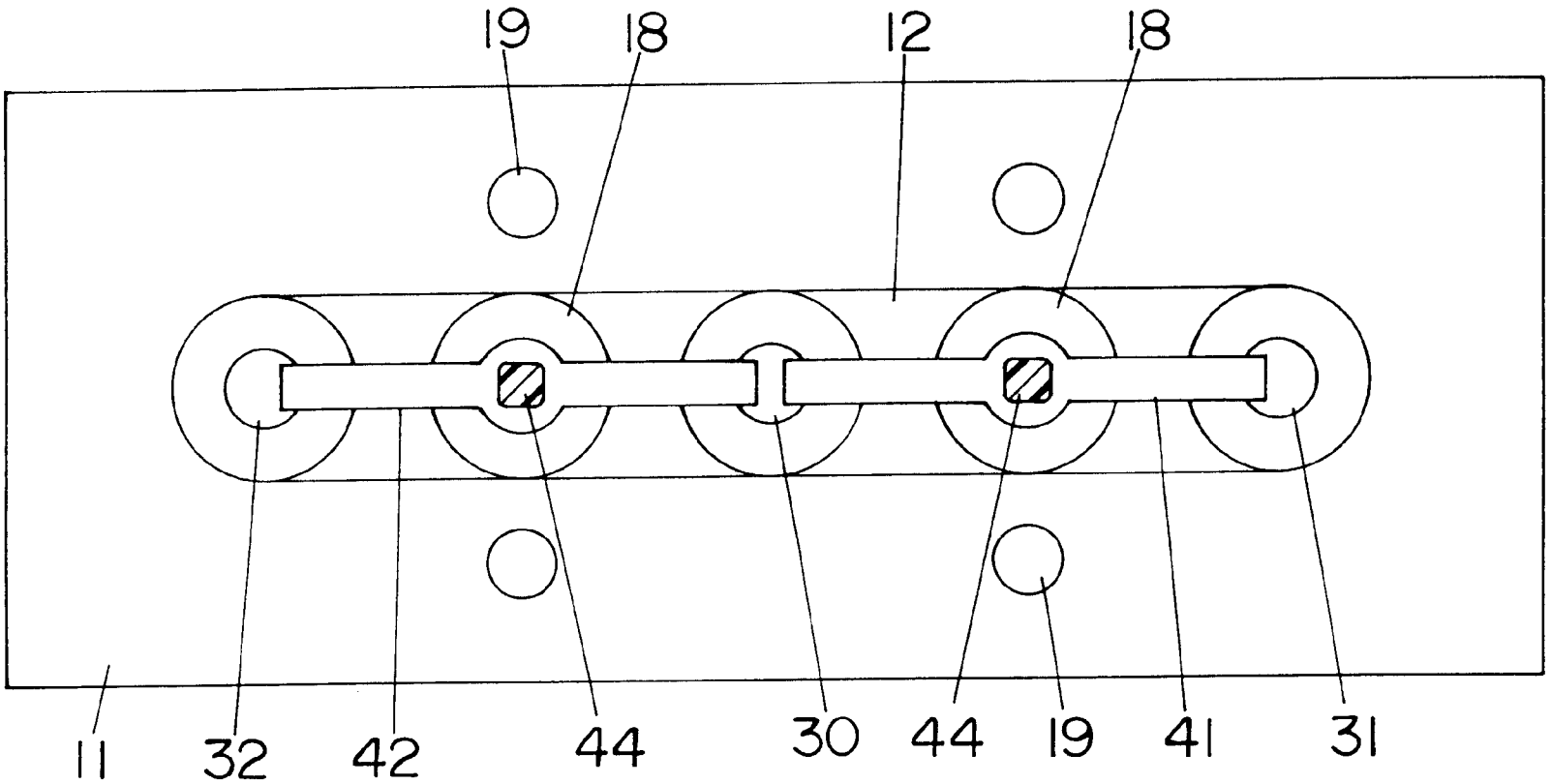
FIG. 5 is a top view of the contact block with a cover plate being removed.

The actuator 44 is made of a liquid crystal polymer (LCP) and is integrally molded at its lower end with the metal-made movable blade 41 (42), so that the actuator 44 can have an accurate dimensional relationship with the movable blade, i.e., the actuator 44 can extend integrally from the movable blade without causing any slack therebetween. For example, as shown in FIG. 4, a projection amount (a) of the dielectric actuator 44 from the lower surface of movable blade 41 (42) into the shield chamber 12 can be accurately controlled with the integral molding, and also the movable blade can be held close to the bottom of the cover plate 15 without leaving any substantial gap therebetween in the contact opening position. This is particularly advantageous to design the contact block 10 having stable high frequency characteristic such as uniform impedance along a signal path extending within the shield chamber 12. In this connection, the base 11 is formed at portions corresponding to the lower end of the actuator 44 with a circular dent 18 of which depth (β) is accurately determined by drilling to give the uniform impedance along the signal path. As shown in FIG. 5, the connection of the actuator 44 to the movable blade 41 (42) is shaped to have a square configuration for avoiding undesired rotation of the actuator 44 about its vertical axis relative to the movable blade. Connection of the actuator 44 to the piece 58 of the return spring 50 is made by inserting the upper end of the actuator into the hole 59 of the piece 58 and heat-welding it around the hole 59. Thus, the actuator 44 can be securely connected to the return spring 50 without giving any undesired distortion or deformation to the return spring 50, and to give an accurate projection amount of the actuator 44 from the top surface of the cover plate 15 for reliable contact closing and opening operation in response to the pivotal movement of the armature 100.

A cover 150 of a dielectric material is fitted over the electromagnet block 60 and is secured thereto by engagement of hooks 89 on the coil bobbins 85 into notches 151 in the lower end of the cover. The cover 150 has an array of openings 152 through which pins of the plug 131 extend.

Turning back to FIG. 4, each coaxial connector 20 includes a dielectric bush 24 held in the upper end of the shield conductor 22. The bush 24 is made of polychlorotrifluoroethylene (PCTFE) and is press-fitted around a reduced-in-diameter section of the core conductor 21 and is also press-fitted in the upper end of the shield conductor 22. When the coaxial connector 20 is threaded into a hole of the base 11, the bush 24 abuts against a seat in the hole. After being threaded into the base 11, the coaxial connector 20 is secured to the base 11 by an adhesive filled in a slit formed in the upper end of the shield conductor 22.

Figure 9:
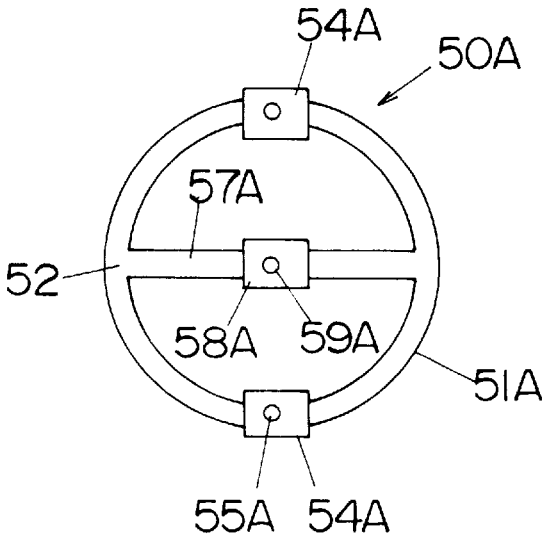
FIGS. 9 and 10 are top views respectively of modified return springs which may be utilized in the above relay.
Figure 10:
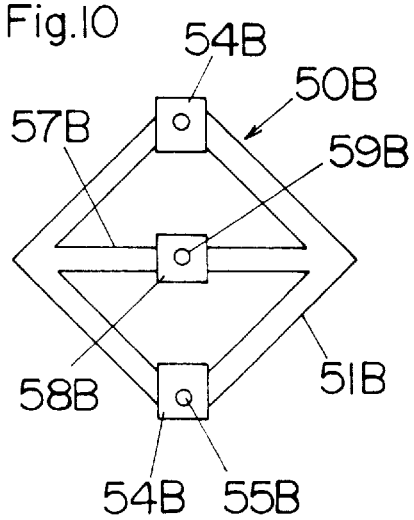

FIGS. 9 and 10 show modified return springs which can be equally utilized in the above relay. The return sprig 50A of FIG. 9 comprises a circular ring 51A with a center spring strip 57A extending between diametrically spaced connection points 52. Formed in the ring 51A at portions angularly spaced from the connection points 52 by 90° are seats 54A each provided with a mount hole 55A for receiving a screw which fastens the return spring 50A to the cover plate and at the same time fasten the cover plate 15 to the base 11. The center spring strip 57A is formed at its longitudinal center with a piece 58A having a hole for connection with the upper end of the actuator 44. In a condition where no eternal force is applied to the return spring 50A, the piece 58B is raised relative to the connection points 52 which are in turn raised relative to the seats 54A. Thus, when the piece 58A is subject to the downward force, the return spring can develop a spring bias of urging the actuator upwardly by resilient deformation of the center spring strip and the portions of the ring between the seats 54A.

The return spring 50B of FIG. 10 comprises a lozenge-shaped ring 51B and a center spring strip 57B extending between two opposed corners of the ring 51B. Formed at the other two corners of the ring are seats 54B with mount holes 55B, respectively for receiving screws which fasten the return spring to the cover plate as well as the cover plate to the base. The center spring strip 57B is formed at its longitudinal center with a piece 58B having a hole 59B for connection with the upper end of the actuator 44. In a condition where no eternal force is applied to the return spring, the piece 58B is raised relative to the connection ends of the spring strip, which are in turn raised relative to the seats 54B. Thus, when the piece 58B is lowered, the return spring 50B can develop a spring bias of urging the actuator upwardly by resilient deformation of the center spring strip 57B and the portions of the ring between the seats 54B. With the use the return springs 50A and 50B, it is also possible to guide the actuator 44 upwardly along its axis without tilting the actuator. It is noted in this connection that the return springs 50, 50A, and SOB of the unique configurations as disclosed in above can be utilized in other relays in which the armature may be mounted either on the contact block or on the electromagnet block.

Figure 11:
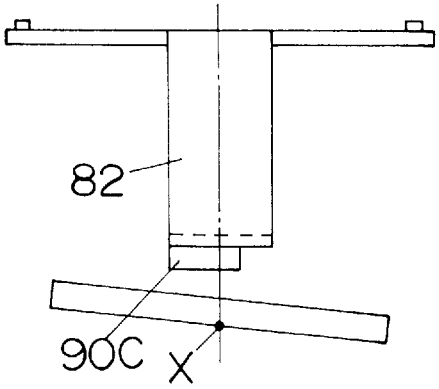
FIG. 11 is a front view illustrating the connection of a permanent magnet with yoke of the electromagnet utilized in a modified relay of mono-stable type.

In the electromagnet block as discussed in the above, the permanent magnet 90 has a horizontal length of which center is vertically aligned with a pivot axis of the armature 100 to give the bi-stable relay operation. However, if is possible to give a mono-stable relay operation when, as shown in FIG. 11, a permanent magnet 90C of reduced width is secured to the bottom of the yokes 82 with the longitudinal center of the permanent magnet 90C is offset horizontally with respect to the pivot axis X. With this structure, the armature 100 is held stable at one of the first and second positions where the armature 100 is attracted by a greater magnetic force than at the other position. Thus, the relay can be made bi-stable or mono-stable simply by changing the permanent magnet.

Figure 12:
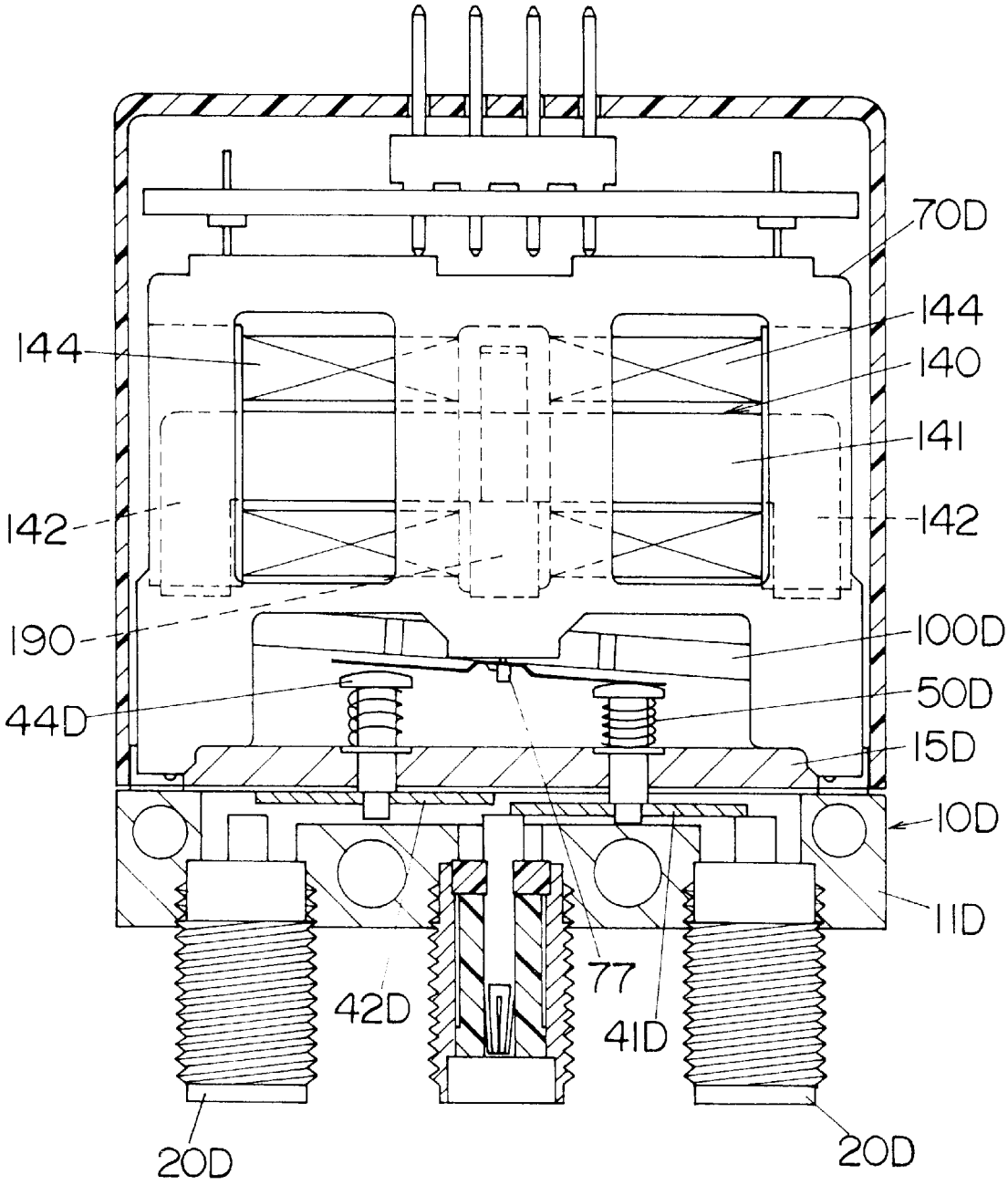
FIG. 12 is a front view in vertical section of a modification of the coaxial relay.

FIG. 12 shows a modification of the above relay which is identical to the above embodiment except for detailed structures of electromagnets. Like parts are designated by like numerals with a suffix letter of "D". The electromagnets utilize a common magnetic member which is a generally U-shaped to have a horizontal core 141 and a pair of pole legs 142 depending from opposite ends of the horizontal core 141. A permanent magnet 190, which is secured to the center of the horizontal core 141, is magnetized to have opposite poles at the upper and lower ends thereof. Coils 144 are wound around the horizontal core 141 on opposite sides of the permanent magnet 190 to constitute the electromagnet. The lower end of the permanent magnet 190 is positioned to oppose the center of the armature 100D, i.e., the pivot axis thereof, while the pole legs 142 define at their respective lower ends pole ends which are opposed to the opposite ends of the armature 100. Thus, the relay is given the bi-stable operation of holding the armature both at the first and second positions.

What is claimed is:

1. A coaxial relay for switching high frequency signals, said relay comprising:

a contact block made of an electrically conductive metal and having a top surface and a shield chamber, said contact block carrying a plurality of coaxial connector each composed of a core conductor and a shield conductor surrounding the core conductor, said coaxial connectors being arranged such that said core conductors extend into said shield chamber to define thereat respective coaxial contacts, said contact block including at least one movable blade which is disposed in said shield chamber for closing and opening two adjacent coaxial contacts, said movable blade being provided with a dielectric actuator which projects on the top surface of said contact block and which is engaged with a return spring secured to the contact block for urging the movable blade in a direction of opening the coaxial contacts;

an electromagnet block separately formed form said contact block and being assembled to said contact block, said electromagnet block carrying at least one electromagnet and an armature, said electromagnet being composed of a core and a coil wounded therearound, said armature being engageable with said actuator when said electromagnet block is assembled to said contact block, said armature responsive to excitation of said coil to move about a pivot axis from a first position of opening said coaxial contacts to a second position of closing the same, wherein said electromagnet block further includes a frame made of a nonmagnetic material for holding said electromagnet, said frame having a retainer mechanism for pivotally supporting said armature and having its one end secured to said contact block.

2. The coaxial relay as set forth in claim 1, wherein said frame comprises a top wall and a pair of opposed sides walls extending from opposite sides of said top wall, each of said side walls formed at its lower end with a pivot projection and with a stem, said armature being an elongated plate and provided at its longitudinal center with a pair of transversely spaced brackets having respective bearing holes for loosely receiving therein said stems, said retainer mechanism comprising said pivot projections, said stems, said brackets with said bearing holes, and a permanent magnet, said permanent magnet being is disposed between said side walls adjacent the lower ends thereof for attracting and holding said armature into a position where said stems loosely fit into said bearing holes and said pivot projections abut respectively against said brackets to define the pivot axis of the armature.

3. The coaxial relay as set forth in claim 2, wherein said contact block includes three coaxial connectors and a pair of first and second movable blades, said three coaxial connectors being arranged to define, within said shield chamber, a common fixed contact by the core conductor of one of said coaxial connectors and first and second fixed contacts by the core conductor of the other coaxial connectors, respectively, said first movable blade being disposed within said shield chamber to close and open the first fixed contact to and from the common fixed contact, said second movable blade being disposed within said shield chamber to close and open the second fixed contact to and from the common fixed contact, said armature being movable about the pivot axis between the first position where said first and second movable blades open and close the first and second fixed contacts from and to the common fixed contact, respectively, and the second position where said first and second movable blades close and open the first and second fixed contacts to and from the common fixed contact, respectively.

4. The coaxial relay as set forth in claim 3, wherein said armature carries on its lower surface a spring plate having a length extending in parallel with the length of said armature, said spring plate including an anchor section formed at the longitudinal center of said spring plate and a pair of first and second spring legs extending from said anchor section in opposite directions, said anchor section being secured to the longitudinal center of said armature and being integral with said brackets extending transversely beyond width ends of said armature for pivotal connection with the lower ends of said frame, said first and second spring legs extending from said anchor section in a spaced relation with said armature to be engageable respectively with the actuators of said first and second movable blade for providing a contact pressure.

5. The coaxial relay as set forth in claim 1, wherein the top surface of said contact block is a rectangular in shape and is formed at its four corners respectively with recesses, said frame comprising a top wall and a pair of end walls extending from opposite ends of said top wall, said top wall being secured to said core, and said end walls being formed at the lower ends thereof respectively with legs which fit into the recesses of said contact block and are bonded thereto.

6. The coaxial relay as set forth in claim 1, wherein said contact block comprises a base carrying said coaxial connectors and a cover plate secured to said base, said cover plate defining said top surface of the contact block and being cooperative with said base to define therebetween said shield chamber, said cover plate being formed with an aperture through which said actuator of the movable blade extends for engagement with said armature.

7. The coaxial relay as set forth in claim 1, wherein said electromagnet block includes a generally U-shaped member having a horizontal core and a pair of pole legs extending from the opposite ends of said horizontal core, said electromagnet block further including at least one coil wound around said horizontal core at portions adjacent said pole legs, and a permanent magnet disposed between pole legs, said permanent magnet being magnetized to have opposite poles at its upper and lower ends and being arranged to have its upper end connected to the center of said horizontal core and to have its lower end opposed to the center of said armature, and said pole legs defining at the one ends thereof pole ends which are opposed respectively to the longitudinal ends of said armature.

8. The coaxial relay as set forth in claim 1, wherein said actuator is made of a dielectric plastic material and is molded integrally at its lower end with the movable blade.

9. The coaxial relay as set forth in claim 8, wherein said actuator is heat-welded at its one end to said return spring.

10. The coaxial relay as set forth in claim 1, wherein said return spring comprises a ring with a center spring strip bridging from opposite ends of said ring, said ring having seats which are spaced from connections between the ring and the center spring strip and secured to said contact block, said connections being raised relative to said seats, said center spring strip having a longitudinal center which is coupled to said actuator and is raised relative to said connections.

11. The coaxial relay as set forth in claim 10, wherein said ring rectangular in shape to have opposite end strips, opposite side strips, and said center spring strip bridging between said opposite ends strips, said opposite side strips being formed at the lengthwise center thereof with said seats, respectively.

12. The coaxial relay as set forth in claim 10, wherein said ring is circular in shape to have said center spring strip extending between two diametrically spaced connection points of said ring, said seats being formed on said ring at portions spaced angularly by 90° from the adjacent connection points.

13. The coaxial relay as set forth in claim 10, wherein said ring is shaped into a lozenge to have said center spring strip extending between two opposed corners, said seats being formed on said ring at the other two corners, respectively.

* * * * *